United States Patent [19]

Hanson

[11] Patent Number: 4,951,782

[45] Date of Patent: Aug. 28, 1990

[54] FOLDABLE SAWHORSE

[76] Inventor: Paul B. Hanson, P. O. Box 291, Union City, Ga. 30291

[21] Appl. No.: 344,267

[22] Filed: Apr. 27, 1989

[51] Int. Cl.[5] ..... B27B 21/00; B25H 1/06

[52] U.S. Cl. ..... 182/153; 182/225

[58] Field of Search ..... 182/153, 181–186, 182/224, 225

[56] References Cited

U.S. PATENT DOCUMENTS

| | | | |
|---|---|---|---|
| 1,556,853 | 10/1925 | Le Beau | 182/181 |
| 2,882,021 | 4/1959 | Dreher | 182/153 |
| 3,045,777 | 7/1962 | Dintelmann | 182/153 |
| 3,481,430 | 12/1969 | Solomon | 182/153 |
| 4,113,056 | 9/1978 | De Lorenzo | 182/153 |

FOREIGN PATENT DOCUMENTS

| | | | |
|---|---|---|---|
| 529934 | 7/1954 | Belgium | 182/153 |
| 2645439 | 10/1976 | Fed. Rep. of Germany | 182/153 |

*Primary Examiner*—Reinaldo P. Machado

*Attorney, Agent, or Firm*—Hurt, Richardson, Garner, Todd & Cadenhead

[57] ABSTRACT

A foldable sawhorse is disclosed having a main set of leg members with a beam across the upper edges thereof, and a shorter, supporting set of leg members pivotally secured to the main leg members. Strut members extend between the main and supporting legs on each side of the sawhorse, the struts being foldable as the sets of leg members are folded together, the legs and struts assuming a nesting relationship for presenting a thin, folded profile for storage and/or transport. The center support beam is vertically aligned with the midpoint of the open legs to evenly distribute the weight between the uneven length sets of leg members.

15 Claims, 4 Drawing Sheets

FOLDABLE SAWHORSE

BACKGROUND OF THE INVENTION

Sawhorses are often used for supporting items on which some work is being performed. For example, lumber that is being cut, or relatively large pieces which require some pre-assembly before installation, such as doors to which hinges are being added, are generally placed on sawhorses which have been arranged to support the work.

In general, a sawhorse has a central beam mounted at each end on inverted V-shaped support members. There are variations on this central theme; however, few changes have been made to the general design.

Sawhorses may be permanently secured together, i.e., the beam is nailed to the supports, or they may be of a modular design, such as those in which the beam is received in slots formed at the apex of the inverted support member. In either case the sawhorses normally take up much space in transporting the materials to the jobsite, but the space must be provided because the sawhorse is a very necessary tool. In some cases, more than one trip may be required just to transport materials, greatly increasing the time and costs required for a particular job.

SUMMARY OF THE INVENTION

It is, therefore, one of the principal objects of the present invention to provide a sawhorse which can be quickly and easily folded between operative and transport positions, and which, when in transport position, is easily stored in a much smaller area than conventional sawhorses.

Another object of the present invention is to provide a stable support means for receiving items on which some work is being performed.

A further object of the present invention is to provide a foldable sawhorse which is easily and inexpensively constructed and which is durable to provide a long service life.

These and additional objects are attained by the present invention which relates to a foldable sawhorse having generally opposed leg members connected by a central beam or support member. The individual sets of leg members are journalled together for pivotal movement between operative and transport positions. In the operative position, the leg members form an inverted V-shaped support structure and in the folded position the legs are disposed generally parallel to one another. Foldable strut means extend between and stabilize the leg members in their extended position and the sets of leg members may nest together in their folded position, thereby minimizing the required storage space.

Any of a number of suitable materials may be used in constructing the present sawhorse, with a lightweight metal, wood, or plastic material being preferred. The invention provides substantial stability in use yet can be easily stored and/or transported between jobsites or moved around a particular jobsite.

Various additional objects and advantages will become apparent from the below description, with reference to the accompanying drawings.

DETAILED DESCRIPTION OF THE PREFERRED EMBODIMENT

Figure 1:
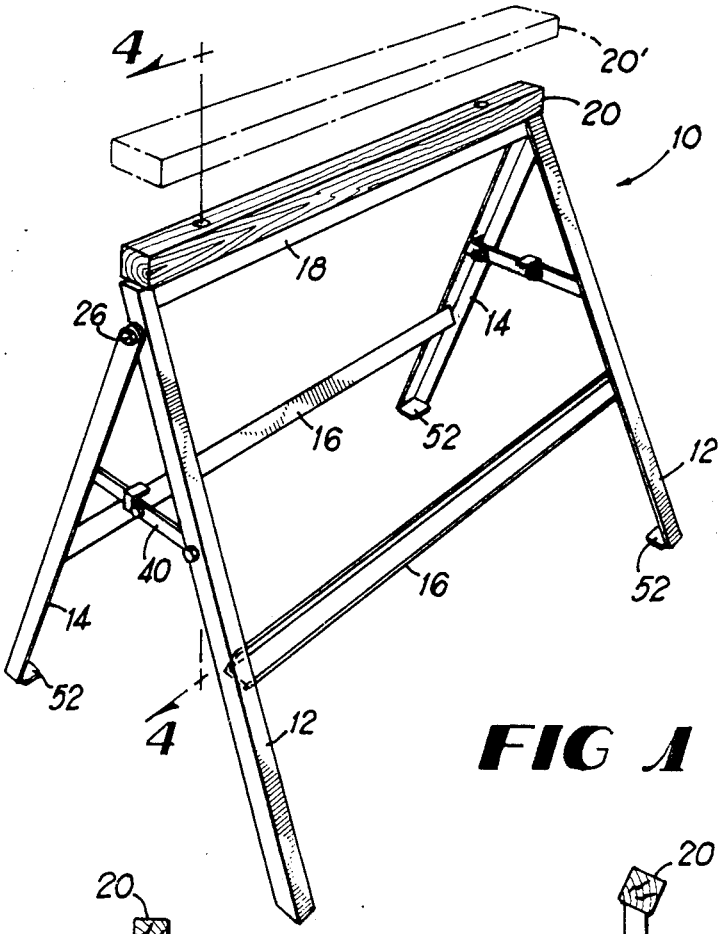
FIG. 1 is a perspective view of one embodiment of the present foldable sawhorse, shown here in operative position, a substitute nailer being projected in broken lines above the installed nailer.
Figure 2:
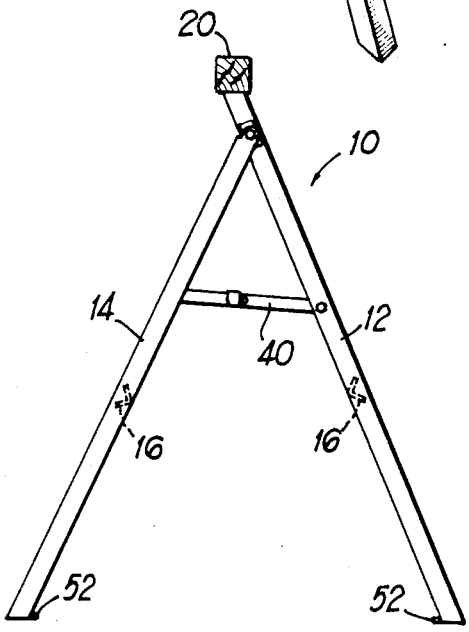
FIG. 2 is a side elevational view of the present sawhorse, shown in operative position.
Figure 3:
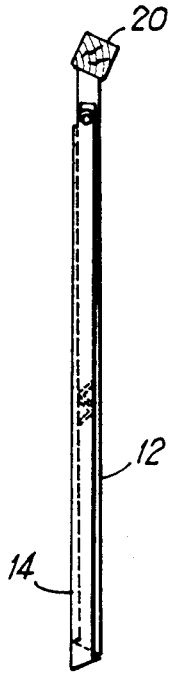
FIG. 3 is a side elevational view showing the sawhorse in folded position.

Referring now more specifically to the drawings, and to FIG. 1 in particular, numeral 10 designates generally one embodiment of the foldable sawhorse, shown in operative position for receiving an item on which some work is to be performed. By comparison, the folded or storage position is shown in FIG. 3, indicating the considerable advantage which the present invention has over conventional non-folding sawhorses.

The device has opposed sets of legs members, each set having a main leg member 12 and a supporting member 14. Bracing means 16 extend between the two main legs and the two supporting legs. The invention is shown as constructed from angle stock, which is particularly well suited for the invention; however, other suitable materials may also be used, such as certain plastics or wood. One advantage of the metal stock shown here is that certain parts, such as the braces 16, may be easily secured by a welding.

Figure 4:
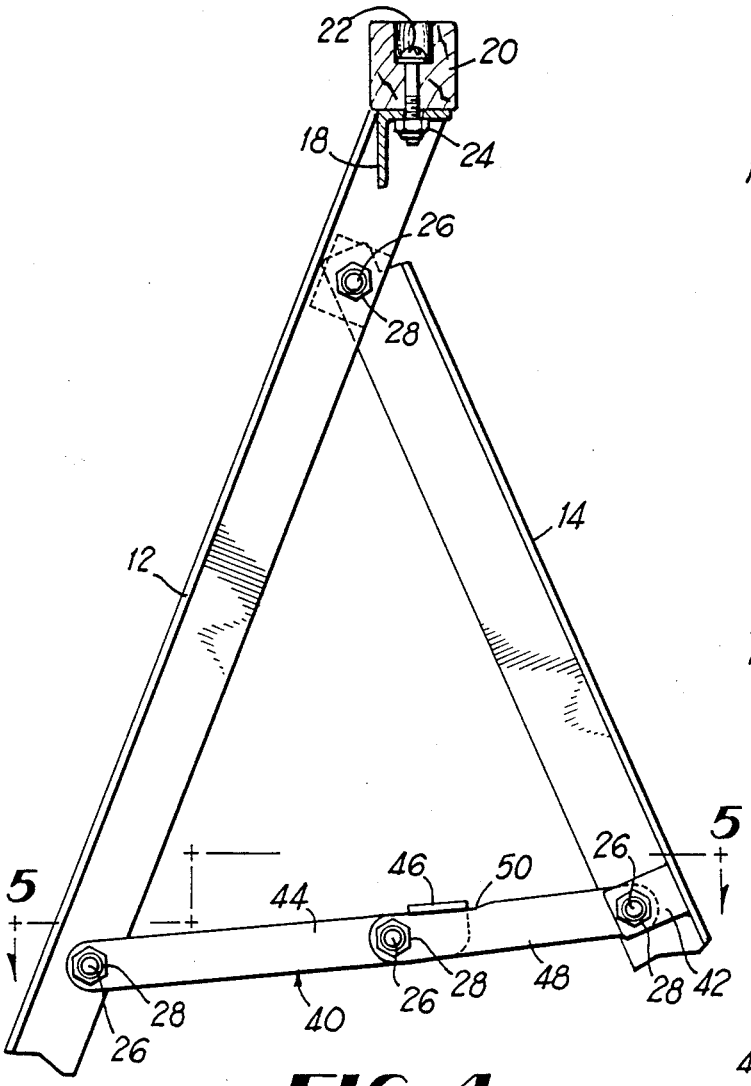
FIG. 4 is a partial side elevational view of the point of connection of the leg members and the foldable strut means.

A cross or support member, such as bar 18, extends between the upper ends of the main legs 12 for receiving the item to be worked on. When in opertive position, the upper surface of the cross member is parallel with the base and directly over the midpoint of the distance between the legs 12 and 14. When folded, the cross member assumes an angular disposition with respect to the base, due to its fixed securement ot the main leg members. This has particular significance in opening and closing the sawhorse, as will be explained hereinbelow. A nailer 20, preferably of wood, may be mounted on the upper surface of the support member if the present sawhorse is constructed of metal, the nailer serving to protect the working surface of saws or other tools. As shown in FIG. 4, the nailer may be bolted or otherwise suitably secured to the cross member 18, such as with bolts 22 and nuts 24. Any suitable size nailer may be mounted on the support 18, as indicated by the broken line projection of a common 2×4, shown in FIG. 1.

The set of main leg members 12 is connected to the set of supporting leg members 14 at two places, near the upper ends thereof and near the center portions thereof. The connection near the upper ends is best shown in FIGS. 3 and 4, the supporting legs being pivotally secured to the main legs with a suitable securing means, such as bolts 26 and nuts 28. As shown, the upper ends of the supporting legs are connected to the main legs near but not at the upper ends thereof. The connection and pivot point of legs 12 and 14 near the upper ends of the legs is a controlled and determined distance from the lower ends of the legs. The connection point is such that in the folded position, the distance from the lower end of leg 12 to the pivot point is slightly less than the distance from the lower end of leg 14 to the pivot point. This allows the legs to be disposed in a nested position when the sawhorse is in a folded position without any interference of the feet 52.

The sets of leg members are also secured together near the center portions thereof, this being best illustrated in FIGS. 4 through 7. A foldable bracing means or strut 40 is pivotally secured at each end to the opposed leg members, one end being pivotally secured to the main leg member 12 and the other end being pivotally secured to a tab means 42 which is secured to the supporting leg 14. The strut is formed as two, generally parallel bar means which are pivotally fastened near their inner ends, opposite the connections to the leg members, and with the point of connection being generally in line with the axial center line of the nailer 20. The points of connection are thus centrally disposed so as to evenly distribute the applied weight between the opposed sets of leg members.

It will be noted from FIG. 4 that one of the parallel bars forming the strut is longer than the other and that the strut is disposed at a slight angle relative to the base or to the upper surface of the nailer 20 when the sawhorse is in operative or open position. The longer bar 44 includes a stop means, such as tab 46 which, when the sawhorse is in open position, engages the upper edge of the shorter bar 48. The shorter bar is notched or indented slightly at 50 to receive the stop means 46 and to impart a slight V-shape to the strut when extended. This design allows the present sawhorse to be lifted by the top support member 18 or nailer 20 while in open position and moved to a different location without the legs closing as a slight tension is imparted to the strut means by the leg members, due to the V-shaped configuration.

Figure 5:
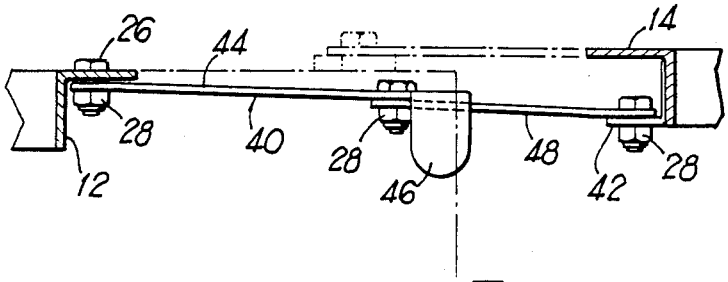
FIG. 5 is a cross-sectional view of the foldable strut in extended position, the view being taken on line 5—5 of FIG. 4.
Figure 7:
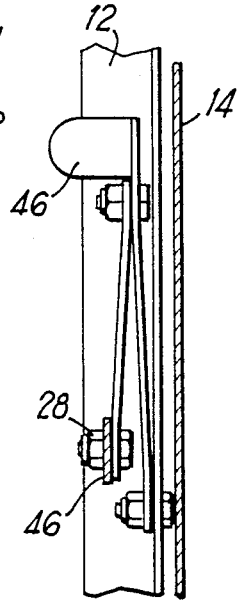
FIG. 7 is a partial side elevational view of the folded strut similar to the preceding figure, the view being taken on line 7—7 or FIG. 6.

The securement of the strut means to the leg member 12, the tab means 42, and the connection of the strut bars is accomplished with bolts 26 and nuts 28; however, any suitable securing means allowing a pivotal connection may be used. As shown in FIGS. 5 and 7, the connection points of the struts to the leg member 12 and the tab means 42 are offset from each other both horizontally and vertically. Thus, the strut can fold, the bars being in different planes, as shown in FIG. 7, without the elements thereof interfering with one another.

Figure 6:
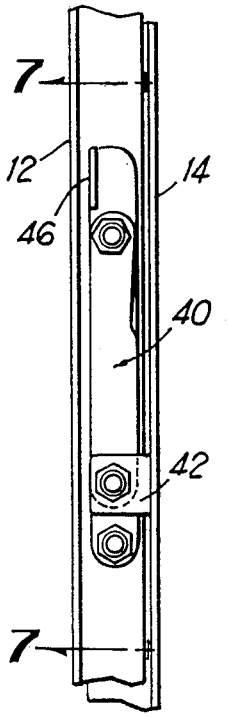
FIG. 6 is a partial side elevational view of the strut shown in folded position.

With the present sawhorse in open position, the folding operation is conveniently accomplished by lifting the center portions of the strut members, preferably while the sawhorse is resting on the ground or other base. The struts can thus be placed in an inverted V-shaped configuration while all four legs remain on the ground. Then, as the central beam or nailer is lifted, the supporting legs 14 swing toward the main legs and enter into a nesting relationship therewith, as shown in FIGS. 3 and 6. The sawhorse thus presents a very thin profile which facilitates storage and/or transport. These figures also illustrate a further advantage in using angle stock for the construction of the sawhorse in addition to its strength and the ability to have portions welded together. The angle stock also nests together in close relationship and provides a housing-like area in which to receive the folded strut 40.

The sawhorse is supported on the ground or base with generally rectangular pad means or feet 52. The feet are secured to the lower ends of the leg members in any suitable manner, as by welding, and as shown in FIG. 3, the bottom ends of the legs and the pads are disposed at an approximate thirty (30) degree angle, so as to provide a substantially flush engagement with the base when the legs are in operative position. In the alternative, the feet may be pivotally mounted so as to flushly engage the ground of the base.

In the use and operation of the present sawhorse, the design presents a number of mechanical advantages which are not found in prior art sawhorse designs. The disposition of the central support member 18 and/or the nailer 20 above and vertically in line with the midpoint of the distance between the main and support legs provides even weight distribution even though the supporting legs 14 are shorter than the main leg members 12. The difference in the length of the legs ensures that a thin, nested profile is presented for storing and/or transporting the sawhorse.

Opening the sawhorse, that is, going from the position in FIG. 3 to the operative position of FIG. 1 may be accomplished with one hand by holding the device by the nailer 20 and tipping the sawhorse to one side, the operation being facilitated by the fixed angular securement of the cross member to the main leg members. This causes the supporting legs 14 to pivot away from the main legs and extends the strut 40. The strut locks in operative position due to its V-shaped configuration when open or extended, thereby keeping the legs separated for transporting the sawhorse, the strut means 40 are moved to an inverted V position while the legs remains on the ground. As the device is lifted by the center member, the supporting legs swing toward and nest with the main legs. The device is thus very convenient to use and to store, and provides substantial strength without attendant weight.

Figure 8:
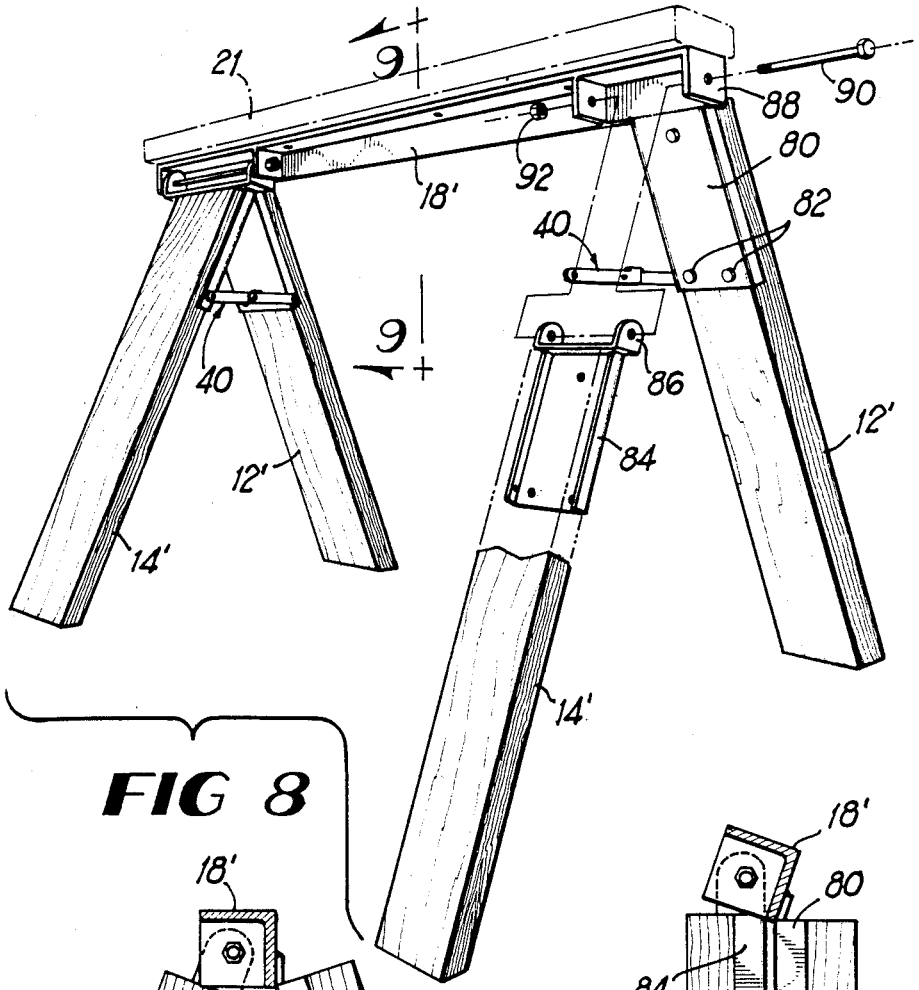
FIG. 8 is a perspective, partially exploded view of an alternate embodiment of the present invention.
Figure 9:
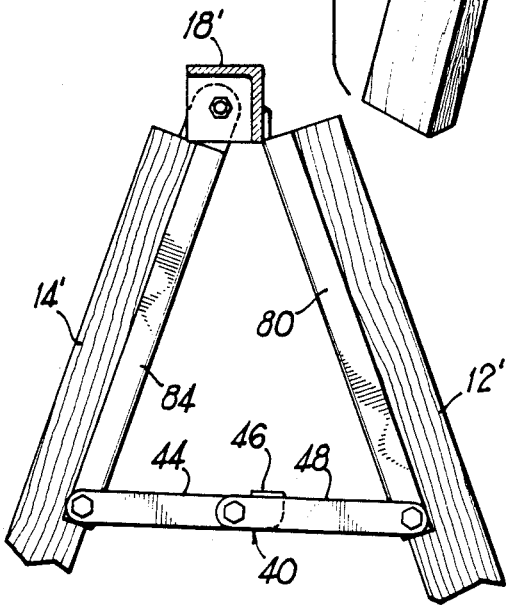
FIG. 9 is a partial, side elevational view of the upper portion of the alternate embodiment, shown with the legs in open position.
Figure 10:
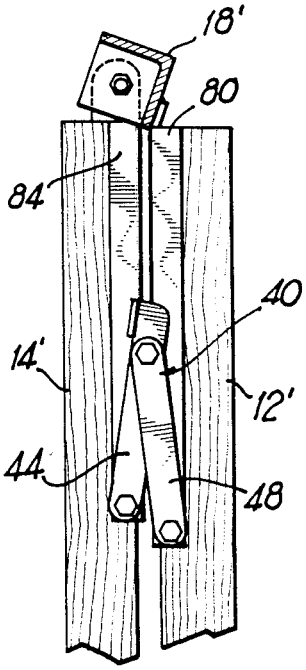
FIG. 10 is a partial, side elevational view similar to the preceding figure, shown here with the legs in closed position.

A second embodiment of the present invention is shown in FIGS. 8 through 10. A main set of leg members 12' are secured to bracket member 80 with suitable securing means such as bolts 82. This bracket 80 is integrally joined to cross member 18', which may be provided with a nailer 21, shown in broken lines. Supporting leg members 14' are held at their upper ends in bracket members 84 with suitable fasteners (not shown), the bracket members 84 having a U-shaped upper portion 86. Thus U-shaped portion is received between opposed tab members 88 which depend downwardly from cross member 18'. This connection is then pivotally secured with a carriage bolt 90 and nut 92, the bolt extending through the tab members and the U-shaped portion 86 as shown in FIG. 8.

Extending between the sets of leg members and secured respectively to the brackets 80 and 84 are strut means 40, their orientation and operation being the same as previously discussed in relation to the first embodiment. In addition, since the cross member is effectively fixed to the main leg members 12', the operation of opening and closing the sawhorse is essentially the same as discussed for the first embodiment. Thus, when in closed position, the cross member may be grasped and tilted such that the upper surface of the cross member approaches its operation position, parallel with the base. This causes the leg members to swing apart, thereby automatically extending and locking the strut means.

This alternate embodiment shares many of the same features with the previous embodiment. Particularly important, however, is the disposition of the cross member 18' over the midpoint between the open legs for evenly distributing the applied weight, and the one-handed operability of the device.

In addition, this embodiment is also very easy to construct, common 2×4 boards being suitable for the leg members. The bracket assembly could be provided separately if desired, the user needing only to pre-drill holes for the connection of the leg members to the brackets, and to cut the bottom ends of the leg members so they reset flushly with the ground when the sawhorse is in open or operative position.

Figure 11:
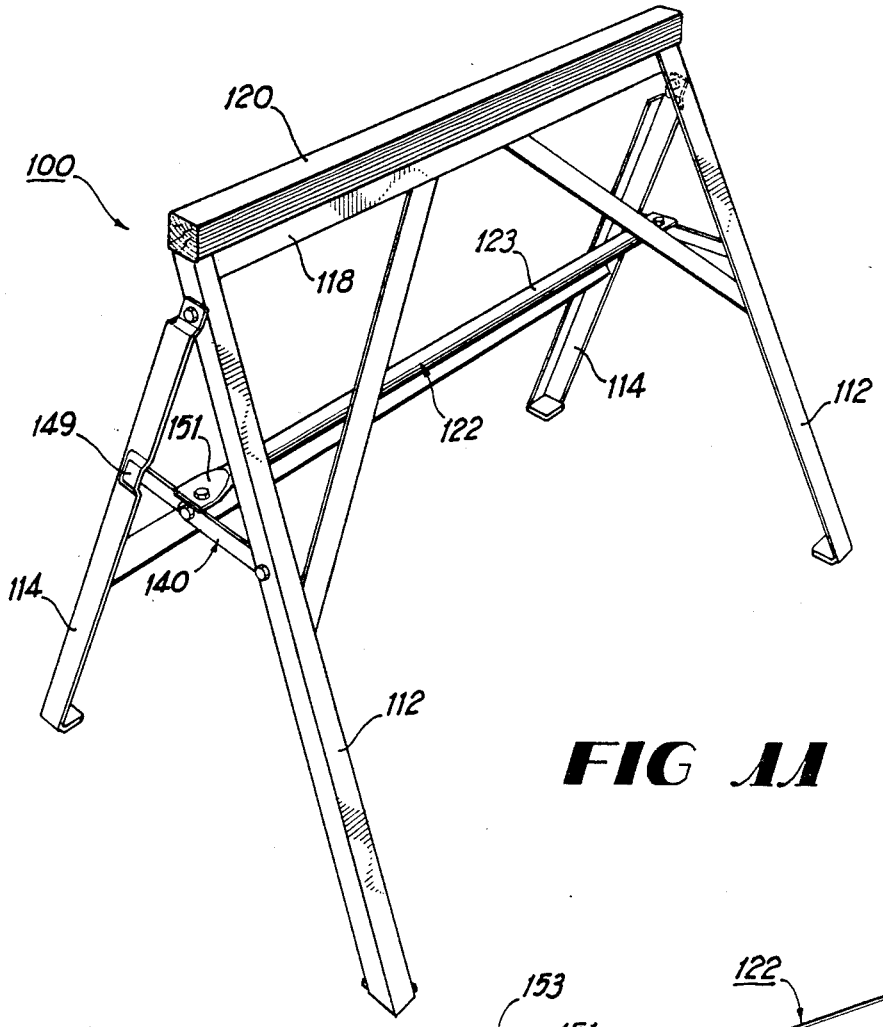
FIG. 11 is a perspective view of an alternative embodiment of the present invention.
Figure 12:
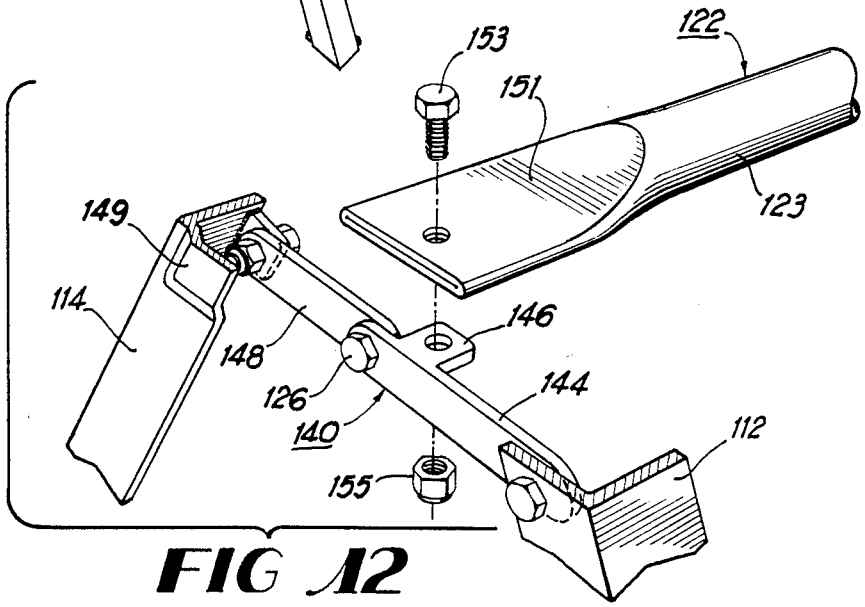
FIG. 12 is an enlarged, partial, exploded view of the strut and operator bar arrangement of the embodiment shown in FIG. 11.

An alternative embodiment of the present invention, designated generally by numeral 100, is illustrated in FIGS. 11 and 12. In this embodiment, the concepts of opening the unit with one hand and the ability to carry the sawhorse from place to place while opened, without its folding until desired, are maintained in a slightly modified version. Referring to FIG. 11, it will be noted that the main leg members 112, the supporting leg members 114, and the central support member 118 and/or nailer 120 are basically the same as in the first-described embodiment. The members also have same spatial relationships with regard to the operative and folded positions.

An added feature of this third embodiment is the provision of an operator bar 122 which extends transversely between the opposed strut means 140. The strut means 140 are also modified slightly in that the stop means on tab 146 is provided on the longer strut member 144 as in the previous embodiments, but is disposed between the point of connection of the strut member 144 to the leg 112 and the connection of the strut membrer 144 to the strut member 148. In addition, a well 149 is provided in legs 114 to receive the bolts 126 which are used to connect the strut members.

The operator bar may be formed from any suitable stock, such as the tubular form 123 shown in FIGS. 11 and 12, and includes generally flattened ends 151. The flattened ends are connected to the tab means 146, respectively, with suitable connecting means such as bolts 153 and nuts 155. The flattened ends 151 engage each of the connected strut members on both sides of the sawhorse when the sawhorse is in its open position. The engagement of the bar 122 with the strut means arrests their movement when the sawhorse has reached its fully open position. The connection of the bar 122 with each of the tab means 146 allows one to close the sawhorse by lifting the operator bar upwardly, the folding or pivoting of the strut members serving to pull the legs together into a folded position. This arrangement obviates any need for the user to handle the strut members, thus providing a measure of safety in that the user's fingers can not be pinched by the strut members as they fold. The operator bar may also be used as a carrying handle when the sawhorse is in its folded position and can be used with any of the described embodiments.

Opening the sawhorse 100 from its folded position is easily accomplished with one hand. As in the previous embodiments, the ends of the shorter legs are disposed lower then the ends of the longer legs when the sawhorse is folded. The longer legs are integrally connected with the upper transverse support beam. Thus, with the ends of the shorter legs serving as a base, a slight pressure applied to the upper beam along with a tilting of the sawhorse toward the side with the longer legs causes the longer legs to swing outwardly in an arcuate path. The flattened ends of the support bar engage the strut means to arrest further movement and the strut means assume their fully-extended and V-shaped configuration to hold the legs in opened position until the operator bar is raised.

While an embodiment of a foldable sawhorse and modifications thereof have been shown and described in detail herein, various other changes and modifications may be made without departing from the scope of the present invention.

I claim:

1. A foldable sawhorse having operative and storage positions and adapted to be positioned on a base, comprising main leg members with supporting leg members pivotally joined at pivot points to said main leg members near the upper ends thereof, said supporting leg members being shorter than said main leg members and forming an inverted V-shaped structure in combination with said main leg members when in said operative position and wherein the distance along said main leg members between said pivot points and the lower ends of said main leg members is less than the distance along said supporting leg members between said pivot points and the lower ends of said supporting leg members, foldable strut means extending between and pivotally secured to said main leg members and said supporting leg members at each side of said V-shaped structure for selectively maintaining said leg members in said operative position, said strut means having right and left bar means pivotally secured together near their opposed end portions opposite the connection to said leg members and wherein the points of connection of said strut means to said main leg members are disposed below the points of connection of said strut means to said supporting leg members for disposing said strut means at an angle relative to said base, a support member secured to and extending between the upper ends of said main leg members and in substantially vertical alignment with the midpoint between said leg members when in said operative position, and pad means secured to the lower ends of said leg members.

2. A foldable sawhorse as defined in claim 1 in which said right and left bar means are substantially parallel to one another in separate planes and form a V-shaped member when in extended position for resisting unintentional folding of said strut means.

3. A foldable sawhorse as defined in claim 2 in which one of said strut bar means includes an indented upper edge portion and the other of said strut bar means includes a stop means for engaging said intended edge when said strut means is in extended position.

4. A foldable sawhorse as defined in claim 3 in which said main and supporting sets of leg members include pad means on the lower edge thereof for supporting said sets of leg members.

5. A foldable sawhorse as defined in claim 1 and including an operator bar having one end secured to one of said strut means and an opposite end secured to the other of said strut means for raising said strut means to a folded position and drawing said sets of leg members together for folding said sawhorse.

6. A foldable sawhorse having an operative position forming an inverted V-shaped structure and adapted to be positioned on a base, and a storage position, said sawhorse comprising first leg members having a bar means secured to and extending between the upper ends thereof, said bar means having an upper surface disposed parallel to the base when the sawhorse is in the operative position and an angular disposition when the sawhorse is in the storage position, second leg members shorter than said first leg members and having upper ends pivotally securedd to each of said first leg members at pivot points below the upper ends thereof for supporting said first leg members and wherein the distance along said first leg members between said pivot points and the lower ends of said first leg members is less than the distance along said second leg members between said pivot points and the lower ends of said second leg members, strut means extending between said first and second pivotally connected leg members at each side of the sawhorse, each strut means having generally parallel bars in separate planar relationship with one end pivotally secured to said first and second leg members respectively, and opposite ends pivotally secured to one another substantially in vertical alignment with said bar means for equally distributing applied weight between said leg members, and feet secured to the lower ends of said leg members.

7. A foldable sawhorse as defined in claim 6 in which said generally parallel bars have an extended position and a folded position, and said bars form a V-shaped member when in extended position, having diverging axes for resisting folding of said strut means.

8. A foldable sawhorse as defined in claim 7 in which one of said strut bar means includes an indented upper edge portion and the other of said strut bar means includes a stop means for engaging said indented edge portion when said strut means are in extended position.

9. A foldable sawhorse as defined in claim 6, in which the points of connection of said bars to said first set of leg members are disposed lower than the points of connection of said bars to said second set of leg members for disposing said strut means at an angle relative to the base when said strut means are extended.

10. A foldable sawhorse as defined in claim 9 in which said first and second sets of leg members include pad means on the lower edge thereof for supporting said leg members on a base.

11. A foldable sawhorse as defined in claim 6 in which each of said second leg members are disposed in a plane outside the plane of said first leg members for disposing said sets of leg members in nesting relationship when in said storage position.

12. A foldable sawhorse as defined in claim 6 and including an operator bar having one end secured to one of said strut means and a opposite end secured to the other of said strut means for raising said strut means to a folded position and drawing said sets of leg members together for folding said sawhorse.

13. A foldable sawhorse having operative and storage positions and adapted to be positioned on a base, comprising an elongate cross member, first brackets secured to each end portion of said cross member, first leg members secured at their upper end portions to said first brackets, second leg members pivotally joined to said cross member and extending downwardly therefrom and strut means disposed between and connected respectively to a main leg member and its pivotally associated supporting leg member on each side of said sawhorse.

14. A foldable sawhorse as defined in claim 13 in which the points of connection of said strut means to said first set of leg members are disposed lower than the points of connection of said strut means to said second set of leg members for disposing said strut means at an angle relative to the base.

15. A foldable sawhorse as defined in claim 13 and including an operator bar having one end secured to one of said strut means and an opposite end secured to the other of said strut means for raising said strut means to a folded position and drawing said first leg members toward said associated second leg members for folding said sawhorse.

* * * * *